US006695281B2

(12) United States Patent
Williams, Jr.

(10) Patent No.: US 6,695,281 B2
(45) Date of Patent: Feb. 24, 2004

(54) WATER FLOW CONTROL DEVICE INCORPORATING WATER LIMITING VALVE

(76) Inventor: Edward Chuck Williams, Jr., P.O. Box 482, Macedonia, OH (US) 44067

( * ) Notice: Subject to any disclaimer, the term of this patent is extended or adjusted under 35 U.S.C. 154(b) by 107 days.

(21) Appl. No.: 09/998,609

(22) Filed: Dec. 3, 2001

(65) Prior Publication Data

US 2003/0102447 A1 Jun. 5, 2003

(51) Int. Cl.[7] ..... F16K 31/06
(52) U.S. Cl. ..... 251/129.04; 251/129.15
(58) Field of Search ..... 251/129.01–129.22

(56) References Cited

U.S. PATENT DOCUMENTS 3,415,278 A 12/1968 Yamamoto et al.
3,581,984 A * 6/1971 Buechner
4,889,148 A * 12/1989 Smazik ..... 251/129.07
4,915,347 A * 4/1990 Iqbal et al. ..... 251/129.04
4,921,211 A * 5/1990 Novak et al. ..... 251/129.04
4,941,219 A * 7/1990 Van Marcke ..... 251/129.04
5,025,516 A 6/1991 Wilson
5,829,072 A 11/1998 Hirsch et al.
5,855,356 A 1/1999 Fait
5,868,311 A 2/1999 Creta-Petru
5,893,387 A * 4/1999 Paterson et al. ..... 251/129.04
5,943,712 A * 8/1999 Van Marcke ..... 251/129.01

* cited by examiner

*Primary Examiner*—Paul J. Hirsch
(74) *Attorney, Agent, or Firm*—James A. Hudak

(57) ABSTRACT

A water flow control device that regulates the amount of water flowing through a shower head is disclosed. The device is interposed between the shower head and the water supply line and consists of a sensor and a solenoid that actuates and deactuates a water limiting valve connected in the water supply line. The device can increase or decrease the flow of water through the shower head depending upon the position of the person with respect to the shower head. In this manner, the amount of water used by a person when showering is conserved.

11 Claims, 3 Drawing Sheets

WATER FLOW CONTROL DEVICE INCORPORATING WATER LIMITING VALVE

TECHNICAL FIELD

The present invention relates, in general, to a water flow control device and, more particularly, to a water flow control device that is adaptable to a shower head and which regulates the amount of water used when showering in order to conserve water and reduce energy costs.

BACKGROUND ART

Numerous devices are available to regulate the amount of water that flows through a faucet or a shower head. The objective of these devices is to stop the flow of water from the faucet and/or shower head after a pre-determined period of time or after the person's hands or body are no longer in the vicinity of the faucet or shower head. For example, U.S. Pat. No. 5,868,311 (Cretu-Petra) discloses a flow control device for a faucet comprising a water mixing valve, at least one proximity sensor and a microcomputer. The water mixing valve controls the flow of hot water from a hot water supply line and cold water from a cold water supply line to the faucet. The proximity sensor provides both a water temperature input signal and a water flow input signal which is determined by the distance between an object, such as a person's hands, and the sensor. The microcomputer is responsive to the water temperature input signal to control the water mixing valve in order to produce a mixture of hot and cold water corresponding to the distance between the object and the sensor. The microcomputer is also responsive to the water flow input signal to provide a water flow rate corresponding to the distance between the object and the sensor. In this manner, both the temperature of the water and the water flow rate are controlled in response to the distance between the object and the proximity sensor. Since both the temperature of the water and the water flow rate are controlled, the flow control device disclosed in this reference is very complex.

U.S. Pat. No. 5,025,516 (Wilson) discloses an automatic type of faucet which utilizes an infrared emitter and detector arrangement to determine the presence of an object under the faucet so as to activate a circuit which produces a signal that is used to open or close a solenoid valve in a water supply line. This reference is directed to the structure and positioning of the emitter and detector so as to provide a concentrated zone of effective detection of the object in order to actuate the faucet.

U.S. Pat. No. 5,855,356 (Fait) discloses an automatic type faucet which includes a sensor for determining the distance between the user's hands and the output of the faucet, a mixing valve which regulates the temperature of the water and a controller for processing distance values provided by the sensor. In this manner, the temperature of the water delivered by the faucet is varied depending upon the position of the user's hands relative to the faucet.

U.S. Pat. No. 5,829,072 (Hirsch, et al.) discloses an automatic shower control device which regulates the flow of water through a shower head. The control device includes a detector to determine the presence of a person within the shower stall and to determine whether the person is in close proximity to the detector. In addition, the device includes a timer arrangement to control the amount of time during which water is delivered to the shower head. In this manner, the control of water to the shower head is regulated by the position of the person relative to the shower head and is further controlled by means of a timer arrangement.

All of the devices disclosed in the foregoing references have a relatively complex structure since they control the temperature of the water flowing through the faucet or shower head, the area covered by a proximity sensor, and may include timing devices and/or a microcomputer. Because of the complexity of the structure involved, these devices are rather costly to produce and do not limit or adjust the water flow rate through the faucet or shower head. In view of this, it has become desirable to develop a relatively inexpensive water flow control device for a shower head, or the like.

SUMMARY OF THE INVENTION

The present invention solves the problems associated with prior art water flow control devices and other problems by providing a device that regulates the amount of water flowing through a shower head. The device, which is interposed between the shower head and the water supply line to same, consists of a sensor and a solenoid that actuates and deactuates a water limiting valve connected within the water supply line. The device can increase or decrease the volume of water flow through the shower head depending upon the position of the person with respect to the sensor or the distance between the person and the sensor.

Operationally, when a person is entering a shower stall, he or she opens the water "mixing" valve associated with the shower head. When this occurs, the water limiting valve utilized by the present invention allows a small amount of water to immediately flow through a needle valve orifice within the valve to the shower head. When the sensor detects that the person is within the vicinity of the shower head, it actuates the solenoid, which, in turn, causes a diaphragm in the water limiting valve to open allowing an increased amount of water to flow through the shower head. When the person moves away from the shower head, the sensor detects that the person is not positioned under the shower head and deactuates the solenoid which, in turn, causes the diaphragm in the water limiting valve to close allowing only a small amount of water, which is adjustable, to pass through the needle valve orifice to the shower head. When the person has finished showering, he or she closes the water "mixing" valve causing the flow of water through the shower head to cease.

DESCRIPTION OF THE PREFERRED EMBODIMENT

Figure 1:
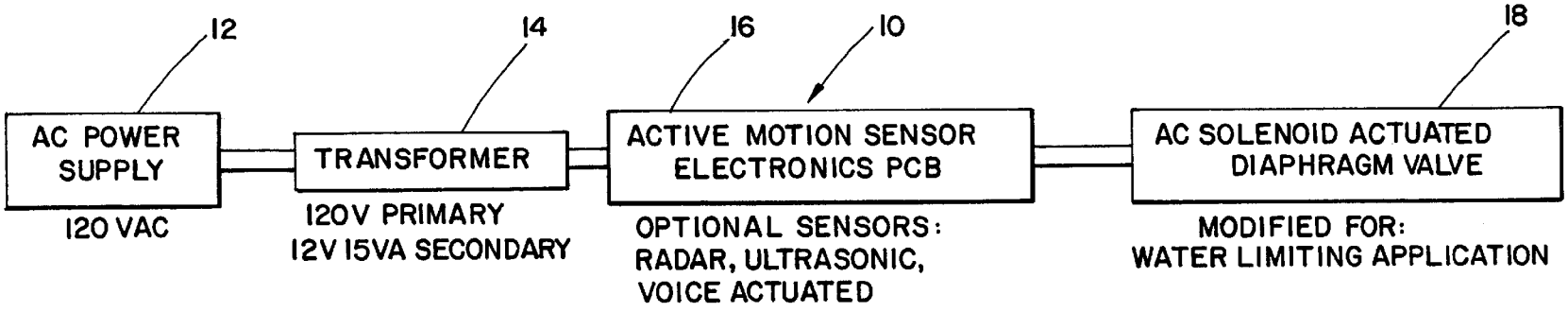
FIG. 1 is an electrical schematic diagram of the AC electrical system utilized by the present invention.
Figure 2:
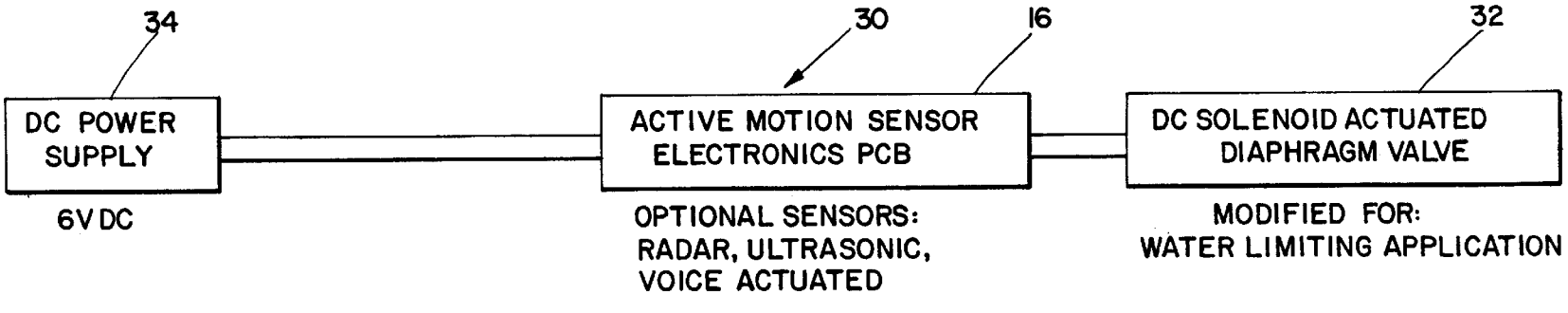
FIG. 2 is an electrical schematic diagram of the DC electrical system utilized by the present invention.

Referring now to the Figures where the illustrations are for the purpose of describing the preferred embodiment of the present invention and are not intended to limit the invention described herein, FIG. 1 is an electrical schematic diagram of the AC electrical system 10 utilized by the present invention. As such, the electrical system 10 includes an AC power supply 12, a step-down transformer 14, a sensor 16 and an AC solenoid actuated diaphragm valve 18. The output of the AC power supply 12, which is typically 120 volts AC, is connected to the input to the transformer 14. The output of the transformer 14, which may be 12 volts AC, is connected to the input of the motion sensor 16. The output of the sensor 16 is connected to the input of the solenoid actuated diaphragm valve 18 which controls the flow of water to the showerhead (not shown). An alternate embodiment of the present invention is shown in FIG. 2 which is an electrical schematic diagram of a DC electrical system 30 to operate a DC solenoid actuated diaphragm valve 32. In this case, the output of a DC power supply 34, which can be 6 volts DC, is connected to the input to the motion sensor 16 whose output is connected to a DC solenoid actuated diaphragm valve 32 which controls the flow of water to the shower head (not shown). In either embodiment, the sensor 16 may sense motion either by infrared or ultrasonic means or may be voice actuated to control the operation of either AC solenoid actuated diaphragm valve 18 or DC solenoid actuated diaphragm valve 32.

Figure 3:
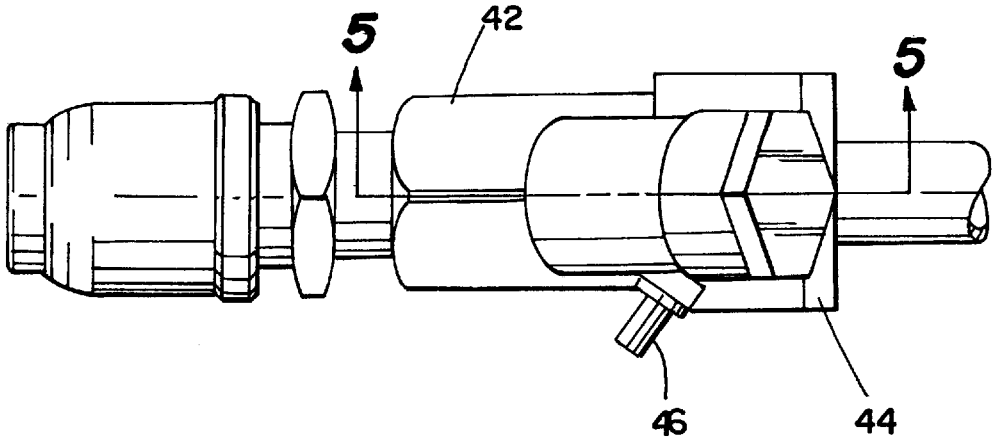
FIG. 3 is a top plan view of a solenoid actuated diaphragm valve, which can be utilized by the present invention.
Figure 4:
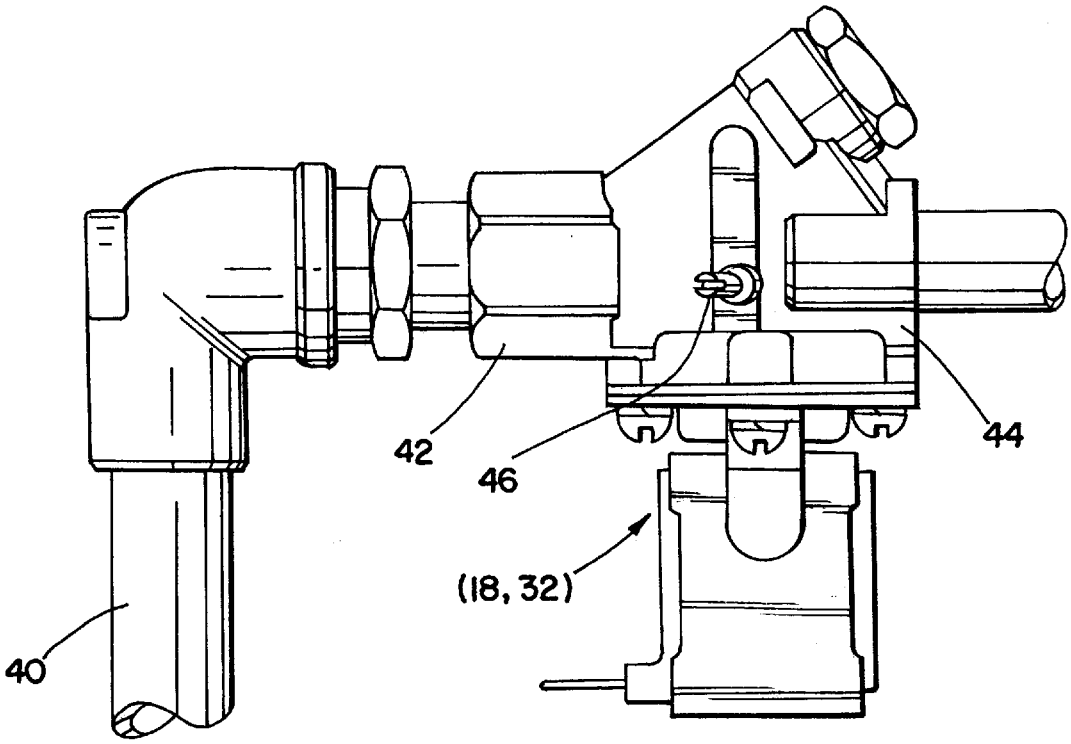
FIG. 4 is a front elevational view of a the solenoid actuated diaphragm valve, shown in FIG. 3, in the closed condition.

Referring now to FIGS. 3 and 4, a top plan view and a front elevational view, respectively, of either an AC solenoid actuated diaphragm valve 18 or a DC solenoid actuated diaphragm valve 32 are shown with a water supply line 40 being connected to its inlet port 42 while its outlet port 44 is connected to a shower head (not shown). It should be noted that the outlet port 44 may not be connected directly to the shower head since the valve 18, 32 may be remotely located from the shower head. The body of the AC solenoid actuated diaphragm valve 18 and the DC solenoid actuated diaphragm valve 32 has a needle valve 46 provided therein. Needle valve 46 acts as an adjustable by-pass for the primary water flow through the valve 18, 32. It is understood that needle valve 46 can be replaced by another by-passing device, such as an adjustable ball valve, connected across the inlet port 42 and the outlet port 44 of valve 18, 32.

Figure 5:
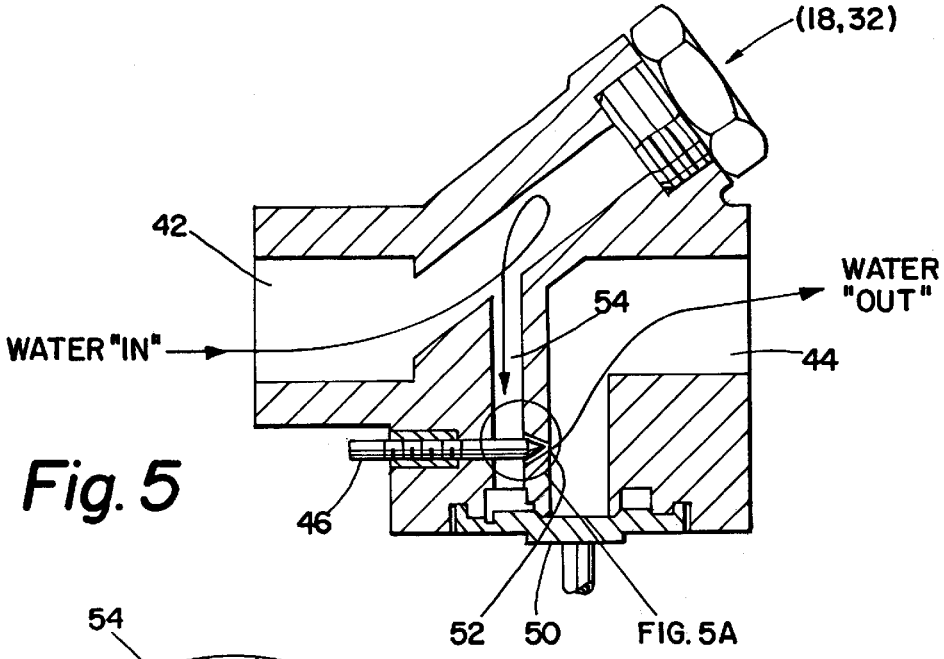
FIG. 5 is a cross-sectional view taken across section-indicating lines 5—5 in FIG. 3 and showing the of a solenoid actuated diaphragm valve in the closed condition.
Figure 5A:
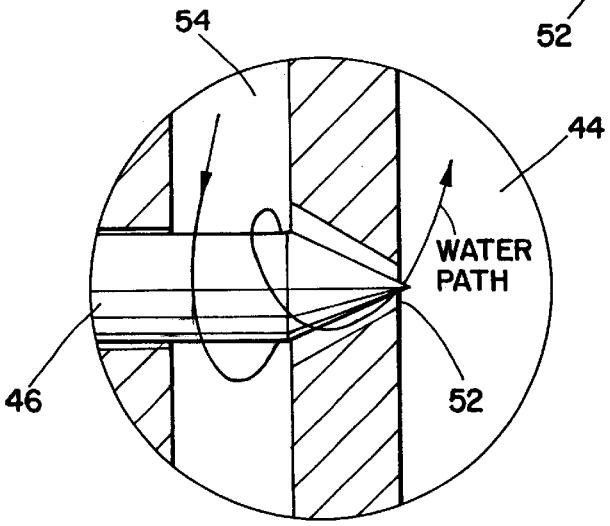
FIG. 5A is an exploded cross-sectional view of the adjustable needle valve orifice utilized in the solenoid actuated diaphragm valve.

Referring now to FIG. 5 which is a cross-sectional view of the body of the AC solenoid actuated diaphragm valve 18 or the DC solenoid actuated diaphragm valve 32, the diaphragm 50, which is attached to the spool (not shown) associated with the solenoid, is shown in the closed condition. In this case, water entering the inlet port 42 of valve 18, 32 is caused to pass through the orifice 52 of needle valve 46 to the outlet port 44 of valve 18, 32. Thus, when the diaphragm 50 is in the closed condition, the only water flow through the valve 18, 32 is through the orifice 52 to the outlet port 44. The amount of water flow through valve 18, 32 when the diaphragm 50 is in the closed condition is adjustable by adjusting needle valve 46 to vary the size of the orifice 52 within the body valve 18, 32.

Figure 6:
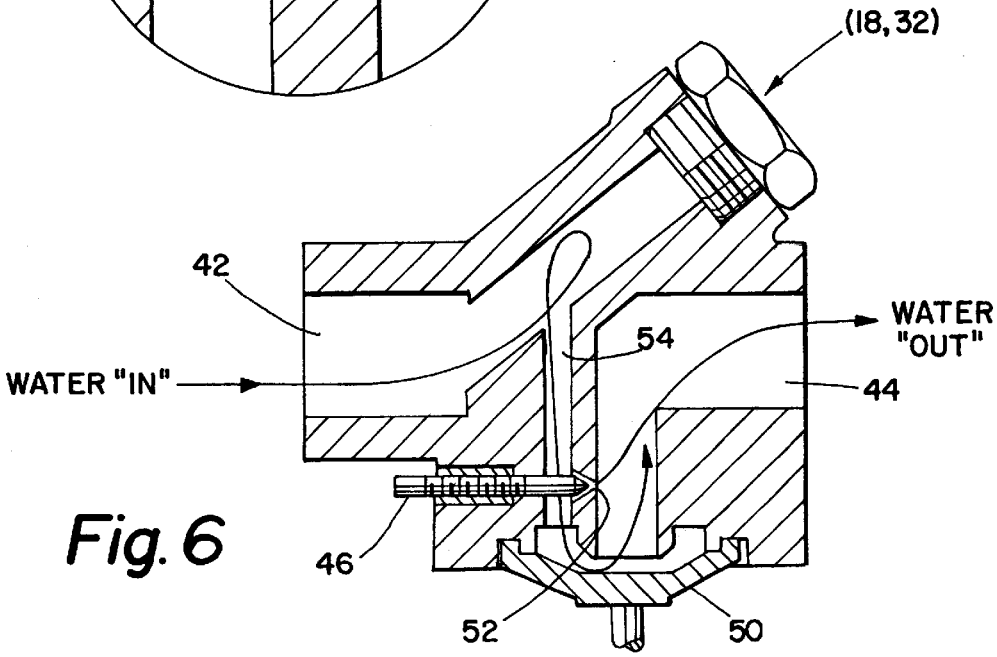
FIG. 6 is a cross-sectional view of the solenoid actuated diaphragm valve, shown in FIG. 3, in the open condition.

Referring now to FIG. 6, another cross-sectional view of the body of the AC solenoid actuated diaphragm valve 18 or the DC solenoid actuated diaphragm valve 32 is shown. In this case, the diaphragm 50, which is attached to the spool (not shown) associated with the solenoid, is in the open condition allowing water to flow from the inlet port 42 through both orifice 52 and passageway 54 to the outlet port 44 of the valve 18, 32. Thus, in this latter case, water flows both through the orifice 52 and through the passageway 54 resulting in a significant increase in the rate of water flow through the valve 18, 32.

Operationally, when a person is entering the shower stall, he or she opens the "mixing" valve associated with the shower head. With the present invention, the "mixed" water flows through the water supply line 40 to the inlet port 42 of either the AC solenoid actuated diaphragm valve 18 or the DC solenoid actuated diaphragm valve 32, depending upon whether an AC electrical system 10 or a DC electrical system 30 is being utilized in the particular application. The water then passes through the orifice 52 to the water outlet port 44 of the valve 18, 32 to the shower head. In this case, only a small amount of water flows through the shower head. After the person enters the shower stall and his or her presence is detected by the sensor 16, the solenoid associated with valve 18, 32 is actuated causing diaphragm valve 50 to open allowing water to flow both through orifice 52 and passageway 54 resulting in a substantially increased rate of water flow through the valve 18, 32. If the person moves away from the sensor 16 while showering, the sensor 16 detects such movements and deactuates the solenoid associated with valve 18, 32 causing diaphragm 50 to close resulting in water flowing only through orifice 52, thus significantly decreasing the amount of water flow through the valve 18, 32 and through the shower head. In this manner, the amount of water used during a shower is conserved. When the person has finished showering, he or she closes the "mixing" valve thus stopping all water flow through the shower head.

Certain modifications and improvements will occur to those skilled in the art upon reading the foregoing. It is understood that all such modifications and improvements have been deleted therein for the sake of conciseness and readability, but are properly within the scope of the following claims.

I claim:

1. A fluid flow control device comprising a power source, means for sensing the presence of an object, and a valve member, said valve member having a first fluid passageway and a second fluid passageway therein, said sensing means electrically interconnecting said power source and said valve member, said valve member having a first mode and a second mode of operation controlled by said sensing means, said first mode of operation permitting fluid flow through said first fluid passageway and said second mode of operation permitting fluid flow through said first and second fluid passageways.

2. The device as defined in claim 1 wherein said power source comprises an AC power supply and a transformer connected thereto.

3. The device as defined in claim 1 wherein said power source comprises a DC power supply.

4. The device as defined in claim 1 wherein said sensing means comprises a motion sensor.

5. The device as defined in claim 4 wherein said motion sensor comprises infrared detecting means.

6. The device as defined in claim 4 wherein said motion sensor comprises ultrasonic detecting means.

7. The device as defined in claim 1 wherein said sensing means comprises a voice actuated sensing device.

8. The device as defined in claim 1 wherein said valve member is solenoid actuated.

9. The device as defined in claim 8 wherein said valve member includes a diaphragm member, said diaphragm member being operated by said solenoid.

10. The device as defined in claim 1 wherein said valve member includes an adjustable needle valve orifice.

11. A flow control device comprising a power source, means for sensing the presence of an object, and a valve member, said valve member including a diaphragm member and an adjustable needle valve orifice, said sensing means electrically interconnecting said power source and said valve member, said valve member having two modes of operation controlled by said sensing means, said valve member being operable so that said needle valve orifice is open in a first mode of operation and said diaphragm member and said needle valve orifice are open in a second mode of operation.

* * * * *